US010641548B2

(12) United States Patent
Skinner et al.

(10) Patent No.: US 10,641,548 B2
(45) Date of Patent: May 5, 2020

(54) PROCESS FOR PRODUCING LIQUEFIED NATURAL GAS

(71) Applicant: GASCONSULT LIMITED, Twickenham (GB)

(72) Inventors: Geoffrey Frederick Skinner, Reading (GB); Anthony Dwight Maunder, Reading (GB)

(73) Assignee: GASCONSULT LIMITED, Twickenham (GB)

( * ) Notice: Subject to any disclaimer, the term of this patent is extended or adjusted under 35 U.S.C. 154(b) by 97 days.

(21) Appl. No.: 15/739,179

(22) PCT Filed: Jun. 23, 2016

(86) PCT No.: PCT/GB2016/000127

§ 371 (c)(1),
(2) Date: Dec. 22, 2017

(87) PCT Pub. No.: WO2017/032960

PCT Pub. Date: Mar. 2, 2017

(65) Prior Publication Data

US 2018/0180354 A1 Jun. 28, 2018

(30) Foreign Application Priority Data

Aug. 21, 2015 (GB) ..... 1514932.1

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0035* (2013.01); *F25J 1/0037* (2013.01);
(Continued)

(58) Field of Classification Search
CPC ..... F25J 1/0022; F25J 1/0032; F25J 1/0035; F25J 1/0037; F25J 1/004; F25J 1/0202; F25J 2220/64
See application file for complete search history.

(56) References Cited

U.S. PATENT DOCUMENTS 5,651,269 A 7/1997 Prevost et al.
2015/0219392 A1 8/2015 Millar et al.
2017/0241709 A1* 8/2017 Lourenco ..... C10L 3/104

FOREIGN PATENT DOCUMENTS

EP 2721358 A2 4/2014
EP 3338043 A1 6/2018
(Continued)

OTHER PUBLICATIONS

Search Report and Written Opinion in International Application No. PCT/GB2016/000127 dated Oct. 20, 2016, 12 pages.
(Continued)

*Primary Examiner* — Brian M King
(74) *Attorney, Agent, or Firm* — Marshall, Gerstein & Borun LLP

(57) ABSTRACT

A process for liquefying methane-rich gases comprising
providing a stream of feed methane-rich gas at a pressure of from 40 bar to 120 bar and containing higher hydrocarbons;
providing a stream of methane-rich recycle gas at a pressure of from 40 bar to 120 bar;
mixing the feed gas with a first part of the recycle gas;
passing the resulting mixture to a gas expander, the expander outlet having a pressure of between 3 bar and 50 bar, so as to form a mixture of vapor and a condensed liquid containing higher hydrocarbons;
separating the expander outlet stream into a liquid stream and a vapor stream;
reheating and compressing said vapor stream to a pressure of from 40 bar to 120 bar to form a first constituent of the above-said recycle gas;
cooling a second part of the said recycle gas to a temperature higher than the outlet temperature of the said expander;
(Continued)

passing said cooled second part of the recycle gas into a liquefaction unit to form liquefied methane and a second vapor stream;

reheating and compressing said second vapor stream to a pressure of from 40 bar to 120 bar to form a second constituent of the above-said recycle gas.

12 Claims, 3 Drawing Sheets

(52) U.S. Cl.
CPC ..... *F25J 1/0202* (2013.01); *F25J 1/0254* (2013.01); *F25J 2220/64* (2013.01); *F25J 2270/06* (2013.01); *F25J 2290/12* (2013.01)

(56) References Cited

FOREIGN PATENT DOCUMENTS

| | | | | | |
|---|---|---|---|---|---|
| GB | 2522421 | A | * | 7/2015 | ..... F25J 1/0037 |
| WO | WO-01/44735 | A1 | | 6/2001 | |
| WO | WO-2012/172281 | A2 | | 12/2012 | |
| WO | WO-2017/032960 | A1 | | 3/2017 | |

OTHER PUBLICATIONS

Combined Search and Examination Report in GB Application No. 1514932.1 dated Mar. 4, 2016, 6 pages.

International Preliminary Report on Patentability and Written Opinion in International Application No. PCT/GB2016/000127 dated Mar. 8, 2018, 9 pages.

* cited by examiner

PROCESS FOR PRODUCING LIQUEFIED NATURAL GAS

FIELD OF THE INVENTION

The present invention relates to a method for liquefying methane-rich gas containing higher hydrocarbons.

BACKGROUND

In the production of liquid methane-rich gas, such as liquid natural gas (LNG) it is generally desired to reduce its content of C5+ hydrocarbons to around 0.1 mol % and of aromatic compounds to below 1 mol ppm to avoid such materials solidifying in the heat exchangers of the liquefaction process. The content of such higher hydrocarbons is normally reduced by means such as cooling the feed gas and removing the condensed liquid, or by washing the feed gas with a suitable hydrocarbon liquid in a so-called "scrub column", or by the use of a solid adsorbent.

However, when the pressure of the feed gas is much higher than 50 bar, the above-mentioned techniques may be insufficient to achieve the desired levels of residual higher hydrocarbons. In such instances provision can be made for the pressure of the feed gas to be reduced significantly, typically in a work expander, its heavy hydrocarbon content then reduced by condensation or scrubbing, and the depleted feed gas recompressed to near its original pressure upstream for the liquefaction step.

SUMMARY OF THE INVENTION

According to the invention there is provided:

a process for liquefying natural gas or other methane-rich gases comprising

- providing a stream of feed methane-rich gas at a pressure of from 40 to 120 bar and containing higher hydrocarbons;
- providing a stream of methane-rich recycle gas at a pressure of from 40 to 120 bar;
- mixing the feed gas with a first part of the recycle gas;
- passing the resulting mixture to a gas expander, the expander outlet having a pressure of between 3 bar and 50 bar, so as to form a mixture of vapor and a condensed liquid containing higher hydrocarbons ($C_{5+}$ hydrocarbons and/or aromatic compounds);
- separating the expander outlet stream into a liquid stream and a vapor stream;
- reheating and compressing said vapor stream to a pressure of from 40 to 120 bar to form a first constituent of the above-said recycle gas;
- cooling a second part of the said recycle gas to a temperature higher than the outlet temperature of the said gas expander;
- passing said cooled second part of the recycle gas into a liquefaction unit to form liquefied methane and a second vapor stream;
- reheating and compressing said second vapor stream to a pressure of from 40 to 120 bar to form a second constituent of the above-said recycle gas.

The invention comprises an adaptation of methane expander based LNG processes, and particularly of the dual methane expander process described in WO 2012/172281, whereby the feed gas is supplied to the said expander and the desired quantity of condensed heavy hydrocarbons is separated from the expander outlet stream.

The invention is applicable particularly to floating LNG production, due to the potential for reducing weight and deck area, and to small scale land-based LNG production from higher pressure natural gases.

The pressure of the feed methane-rich gas is preferably from 50 to 100 bar in which case the recycle gas is preferably also pressurized to 50 to 100 bar. The outlet pressure of the gas expander is preferably from 5 to 30 bar.

Optionally, the mixture of feed gas and part of the recycle gas is cooled in a heat exchanger before admission to the gas expander. Optionally, the outlet stream from the gas expander may be heated or cooled to vary the quantity of higher hydrocarbons in the liquid.

BRIEF DESCRIPTION OF THE DRAWING

The invention will be further described with reference to the accompanying drawings in which.

DESCRIPTION OF PREFERRED EMBODIMENT

Figure 1:
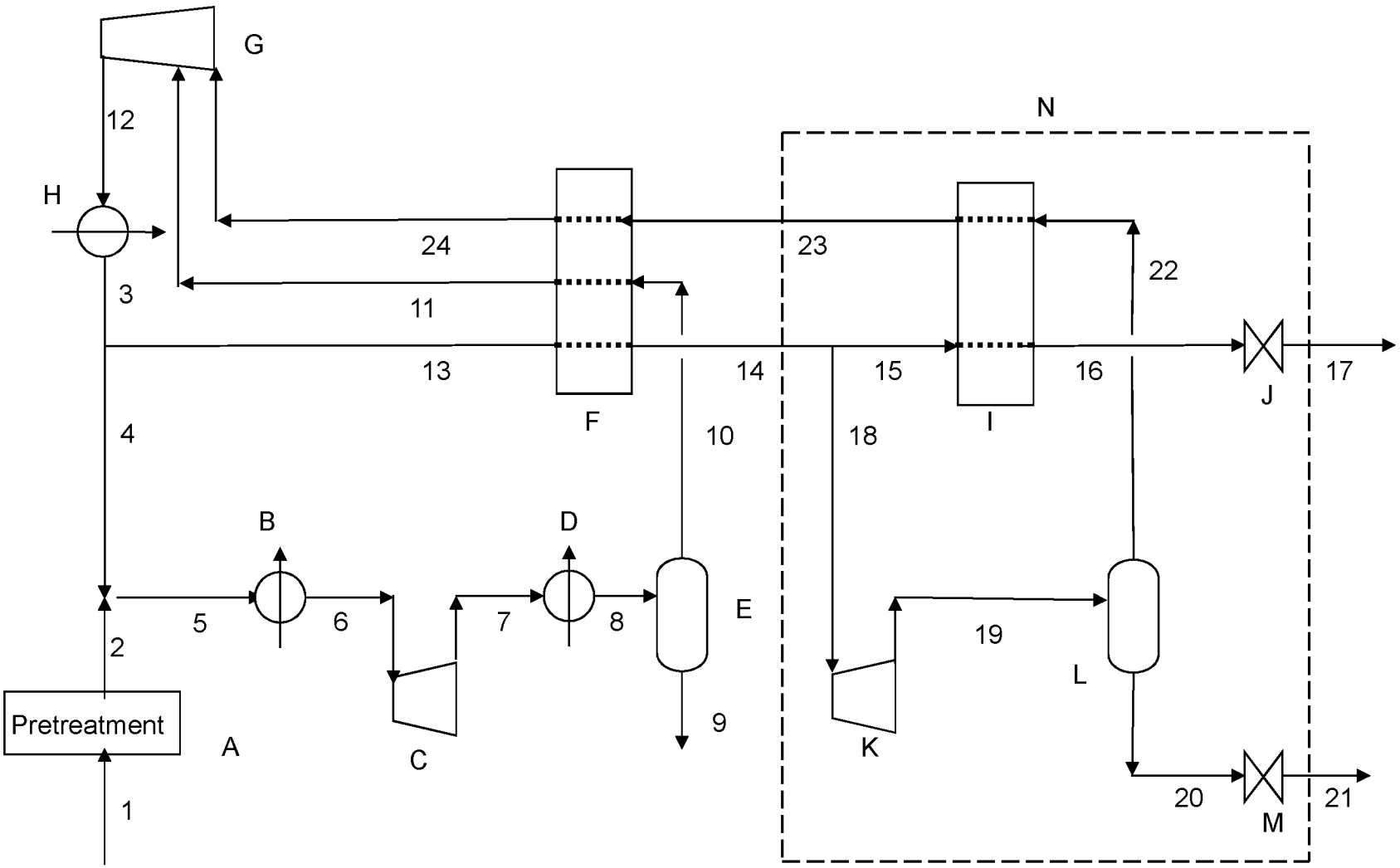
FIG. 1 represents a flow diagram illustrating a process in accordance with the invention.

The exact flow sheet will depend upon the feed gas specification, but will generally contain these basic elements. Where pressures are stated anywhere in this application as "bar", these are bar absolute.

The feed natural gas (1) is passed through a pretreatment stage A in which components such as acid gases, water vapor and mercury may be removed to produce a pre-treated gas (2).

The pre-treated gas is mixed with a first part (4) of a recycle gas (3), described below, comprising typically 30% to 60% of the total recycle gas flow on a molar basis. In the resulting mixture the ratio of the molar flow of the recycle gas to the molar flow of feed gas is typically in the range of 0.5 to 2. The resulting mixture (5), after optionally cooling (6) in cooler B, flows to a gas expander machine C at a pressure of between 40 and 120 bar, more typically between 50 and 100 bar.

The outlet from expander C, stream (7) has a pressure of between 3 bar and 50 bar, and more typically between 5 bar and 30 bar, and may contain a condensate comprising C5+ and/or aromatic compounds. Stream (7) may optionally be further cooled in cooler D (stream 8) so as to increase the amount of condensate formed.

The partially condensed stream (7 or 8) is separated into a liquid (9) and a vapor (10) in separator E. Typically stream 9 contains lighter hydrocarbons in addition to the aforesaid condensed heavy hydrocarbons. This stream will typically be removed from the process for use as fuel, or may be separated into lighter and heavier fractions, with the lighter fraction optionally recycled. In a further option Separator E may form the upper part of a demethanizer column. All these options for separation and subsequent processing of Stream 9 do not form part of the invention.

The vapor (10) from separator E is typically reheated in a first cold passage of heat exchanger F and the stream (11) compressed in compressor G to a pressure of 40 to 120 bar (stream 12) and then cooled in cooler H to form a first constituent of the aforementioned recycle gas (3).

A second part (Stream 13) of the recycle gas (3) is cooled (14) in a hot passage of heat exchanger F and is then passed into a liquefaction unit N shown in dashed outline. The products of the liquefaction unit are liquefied methane (LNG) and a vapor stream (23). In the liquefaction unit the stream (14) is divided. A first part (15), which typically comprises 25% to 35% of Stream 14, is further cooled in a hot passage of heat exchanger I, to form a methane-rich condensate or dense phase (16), which may be depressurized in a valve or turbine J (Stream 17) to produce LNG product.

While the example is based on a liquefaction unit N generally in accordance with WO 2012/172281, other types of liquefaction units could be substituted. In particular, a liquefaction unit which achieved complete liquefaction of the said second part of the recycle gas (14) so that the second vapor stream (23) is zero could be employed.

To provide the most part of the necessary cooling in heat exchanger I, a second part (18) is expanded in a second gas expander K. Any liquid in the expander outlet (19) is separated (20) in separator L and depressurized through valve or turbine M to produce additional LNG product (21).

The vapor from separator L (22) is reheated in a cold passage of heat exchanger I and stream (23) reheated in a second cold passage of heat exchanger F. Stream (24) is then compressed in compressor G to a pressure of from 40 to 120 bar to form a second constituent of the aforementioned recycle gas (stream 3).

According to the invention the pressure of stream (24) may be higher or lower than the pressure of stream (11).

An example of the removal of heavy hydrocarbon and aromatic material is provided in Table 1. The benzene concentration of the feed (2) of 1000 mol ppm is reduced to 1 mol ppm in stream (10). Stream (10) has a composition close to the composition of the LNG product.

Figure 2:
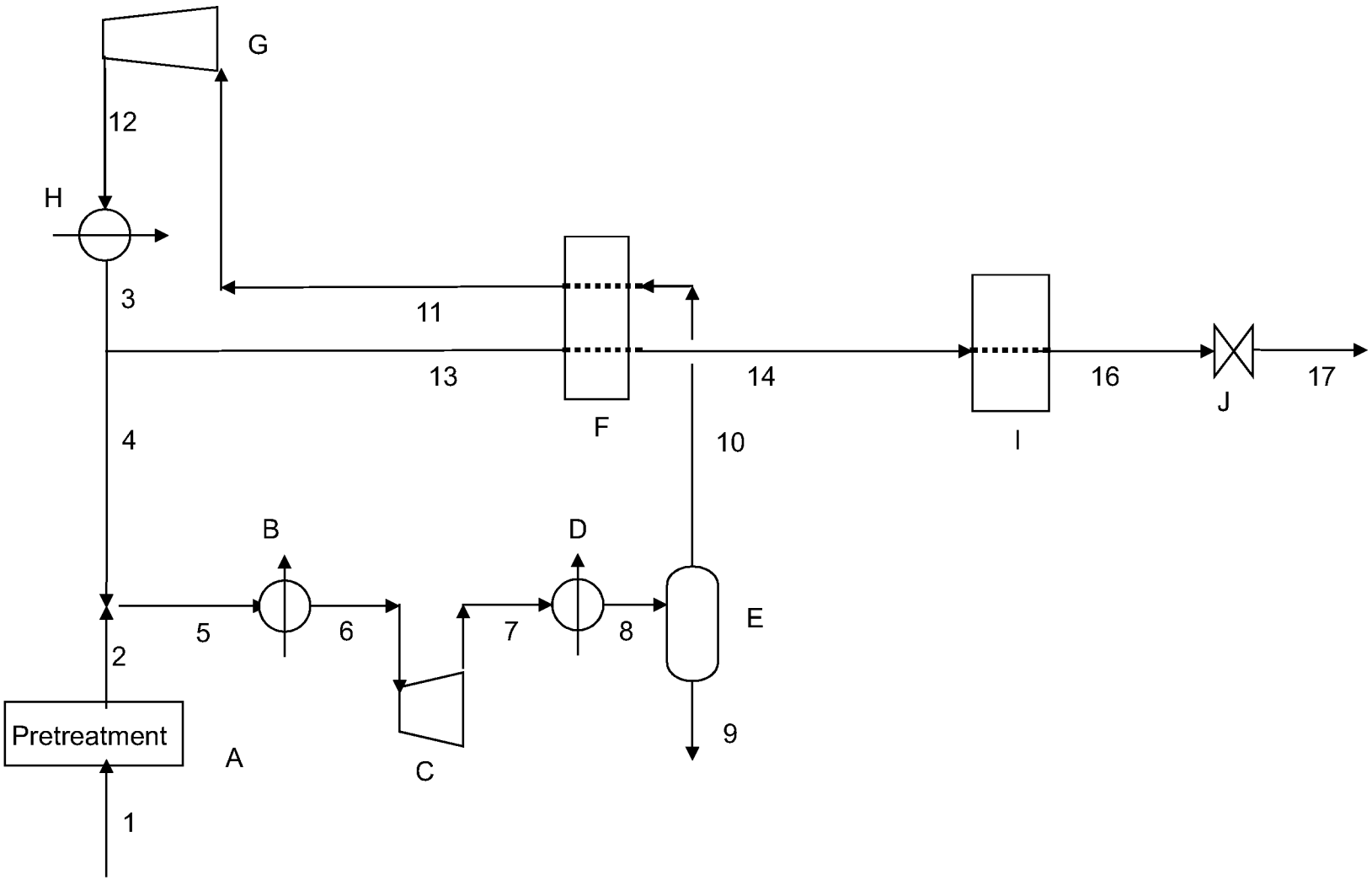
FIG. 2 represents a flow diagram illustrating a process in accordance with another embodiment of the invention.

FIG. 2 represents a flow diagram illustrating a process in accordance with another embodiment of the invention wherein a heat exchanger I completely or substantially liquefies the second part of the recycle gas stream 14 to form liquefied methane 17.

Figure 3:
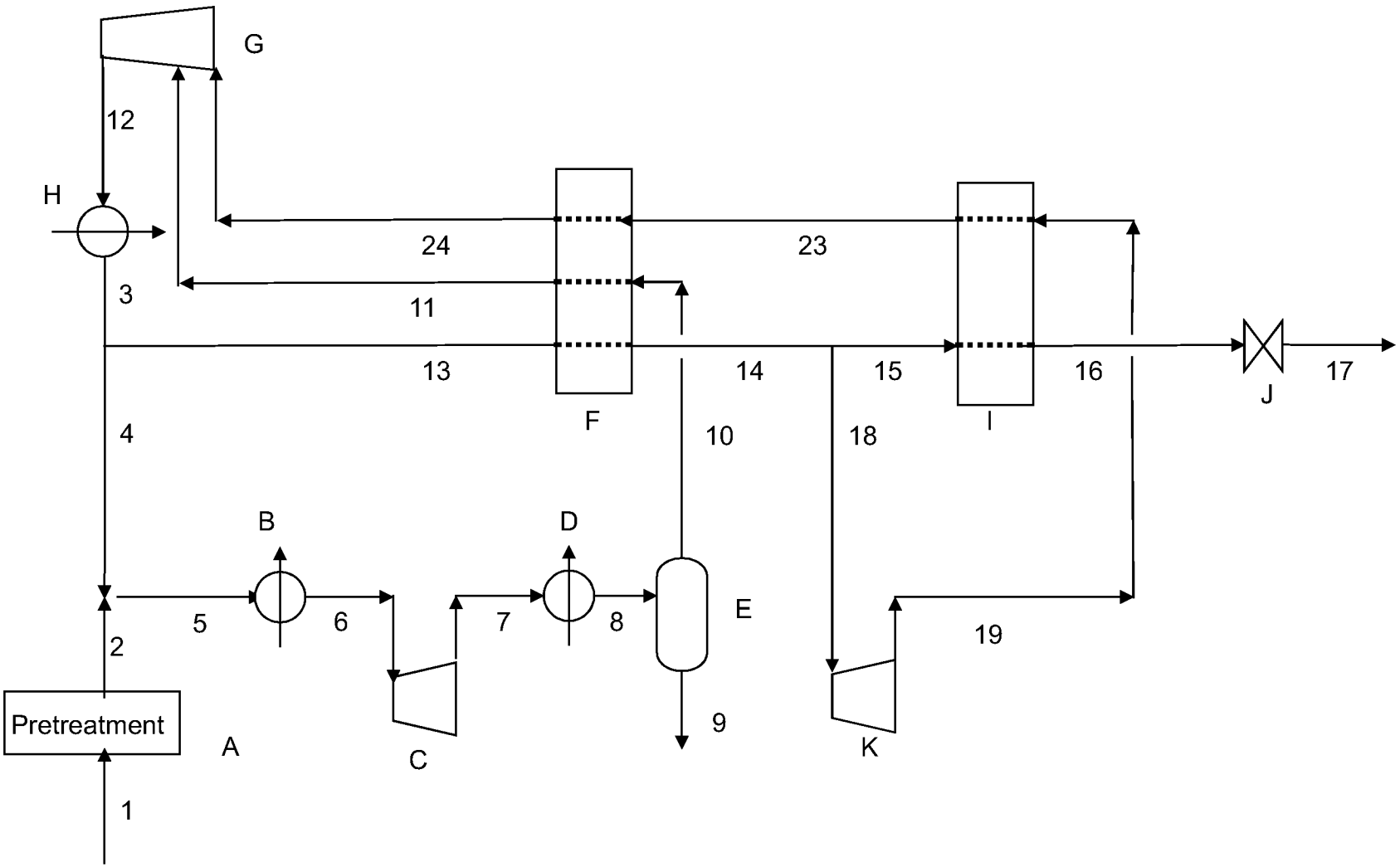
FIG. 3 represents a flow diagram illustrating a process in accordance with yet another embodiment of the invention. Throughout the drawing figures, like reference numerals identify like elements of the drawings.

FIG. 3 represents a flow diagram illustrating a process in accordance with yet another embodiment of the invention wherein there is no liquid in stream 19. Under such conditions, the vapor/liquid separator L and the valve M of FIG. 1 are redundant.

The invention claimed is:

1. A process for liquefying methane-rich gases, the process comprising:

(a) providing a stream of methane-rich feed gas containing higher hydrocarbons comprising $C_{5+}$ hydrocarbons and/or aromatic compounds at a feed gas pressure of from 40 bar to 120 bar;

(b) providing a stream of methane-rich recycle gas at a recycle gas pressure of from 40 bar to 120 bar;

(c) mixing the feed gas with a first part of the recycle gas to form a mixture;

(d) passing the resulting mixture to a first gas expander having an outlet, the first gas expander outlet having a first gas expander outlet pressure of between 3 bar and 50 bar and less than the feed gas and recycle gas pressures, to form a first gas expander outlet stream comprising a mixture of vapor and a condensed liquid containing said higher hydrocarbons;

(e) separating the first gas expander outlet stream into a liquid stream and a first vapor stream;

(f) reheating and compressing said first vapor stream to a first vapor stream pressure of from 40 bar to 120 bar to form a first constituent of said recycle gas;

TABLE 1

| | | Stream No. | | | | | | | |
|---|---|---|---|---|---|---|---|---|---|
| | | 2 | 4 | 5 | 6 | 7 | 8 | 9 | 10 |
| mol fraction | $CO_2$ | 0.000000 | 0.000000 | 0.000000 | 0.000000 | 0.000000 | 0.000000 | 0.000000 | 0.000000 |
| | $N_2$ | 0.010399 | 0.017629 | 0.015034 | 0.015034 | 0.015034 | 0.015034 | 0.000567 | 0.015644 |
| | $CH_4$ | 0.806366 | 0.935888 | 0.889394 | 0.889394 | 0.889394 | 0.889394 | 0.206702 | 0.918189 |
| | $C_2H_6$ | 0.101516 | 0.038661 | 0.061224 | 0.061224 | 0.061224 | 0.061224 | 0.215712 | 0.054708 |
| | $C_3H_8$ | 0.052817 | 0.007219 | 0.023588 | 0.023588 | 0.023588 | 0.023588 | 0.332095 | 0.010575 |
| | i-$C_4H_{10}$ | 0.006795 | 0.000283 | 0.002621 | 0.002621 | 0.002621 | 0.002621 | 0.054901 | 0.000416 |
| | n-$C_4H_{10}$ | 0.012252 | 0.000290 | 0.004584 | 0.004584 | 0.004584 | 0.004584 | 0.103162 | 0.000426 |
| | i-$C_5H_{12}$ | 0.002574 | 0.000016 | 0.000934 | 0.000934 | 0.000934 | 0.000934 | 0.022530 | 0.000023 |
| | n-$C_5H_{12}$ | 0.002986 | 0.000011 | 0.001079 | 0.001079 | 0.001079 | 0.001079 | 0.026281 | 0.000016 |
| | N $C_6H_{14}$ | 0.001544 | 0.000001 | 0.000555 | 0.000555 | 0.000555 | 0.000555 | 0.013681 | 0.000001 |
| | M-cyclopentane | 0.000412 | 0.000000 | 0.000148 | 0.000148 | 0.000148 | 0.000148 | 0.003648 | 0.000000 |
| | Benzene | 0.001000 | 0.000001 | 0.000359 | 0.000359 | 0.000359 | 0.000359 | 0.008853 | 0.000001 |
| | cyclohexane | 0.000206 | 0.000000 | 0.000074 | 0.000074 | 0.000074 | 0.000074 | 0.001824 | 0.000000 |
| | n-$C_7H_{16}$ | 0.000515 | 0.000000 | 0.000185 | 0.000185 | 0.000185 | 0.000185 | 0.004565 | 0.000000 |
| | M-cyclohexane | 0.000206 | 0.000000 | 0.000074 | 0.000074 | 0.000074 | 0.000074 | 0.001826 | 0.000000 |
| | toluene | 0.000103 | 0.000000 | 0.000037 | 0.000037 | 0.000037 | 0.000037 | 0.000913 | 0.000000 |
| | n-$C_8H_{18}$ | 0.000206 | 0.000000 | 0.000074 | 0.000074 | 0.000074 | 0.000074 | 0.001826 | 0.000000 |
| | n-$C_9H_{20}$ | 0.000103 | 0.000000 | 0.000037 | 0.000037 | 0.000037 | 0.000037 | 0.000913 | 0.000000 |
| | $H_2O$ | 0.000000 | 0.000000 | 0.000000 | 0.000000 | 0.000000 | 0.000000 | 0.000000 | 0.000000 |
| ° C. | | 30.0 | 30.0 | 29.5 | 10.0 | −63.3 | −68.3 | −68.3 | −68.3 |
| bar abs | | 65.0 | 64.9 | 64.9 | 64.8 | 14.0 | 13.9 | 13.9 | 13.9 |
| kmol/h | | 5480 | 9786 | 15266 | 15266 | 15266 | 15266 | 618 | 14648 |
| vapor fraction | | 1 | 1 | 1 | 1 | 0.968 | 0.960 | 0 | 1 |
| mol fraction | $C_{5+}$ | 0.009854 | | | | | | | 0.000042 |
| | aromatic | 0.001102 | | | | | | | 0.000001 |

(g) cooling a second part of said recycle gas to a temperature higher than an outlet temperature of said first gas expander;

(h) dividing the cooled second part of the recycle gas into first and second streams, cooling the first stream to form a methane-rich condensate and depressurizing said methane-rich condensate to form a liquid methane product, passing the second stream to a second gas expander to form a mixture of liquid and vapor, and separating said liquid from said vapor to form additional liquid methane and a second vapor stream; and, (i) reheating and compressing said second vapor stream to a second vapor stream pressure of from 40 bar to 120 bar to form a second constituent of said recycle gas.

2. The process according to claim 1, comprising cooling the mixture of feed gas and the first part of the recycle gas in a heat exchanger before passing the mixture to the first gas expander.

3. The process according to claim 1, comprising heating or cooling the first gas expander outlet stream in a heat exchanger prior to separation to modify the quantity of said higher hydrocarbons in the liquid.

4. The process according to claim 1, wherein the methane-rich feed gas pressure and the methane-rich recycle gas pressure are each from 50 bar to 100 bar and/or the first gas expander pressure is from 5 bar to 30 bar.

5. The process according to claim 1, comprising at least partially cooling the second part of the recycle gas by heat exchange with the second vapor stream prior to compressing said second vapor stream.

6. The process as claimed in claim 1, wherein the methane-rich feed gas is natural gas.

7. A process for liquefying methane-rich gases, the process comprising:

(a) providing a stream of methane-rich feed gas containing higher hydrocarbons comprising $C_{5+}$ hydrocarbons and/or aromatic compounds at a feed gas pressure of from 40 bar to 120 bar;

(b) providing a stream of methane-rich recycle gas at a recycle gas pressure of from 40 bar to 120 bar;

(c) mixing the feed gas with a first part of the recycle gas to form a mixture;

(d) passing the resulting mixture to a first gas expander having an outlet, the first gas expander outlet having a first gas expander outlet pressure of between 3 bar and 50 bar and less than the feed gas and recycle gas pressures, to form a first gas expander outlet stream comprising a mixture of vapor and a condensed liquid containing said higher hydrocarbons;

(e) separating the first gas expander outlet stream into a liquid stream and a first vapor stream;

(f) reheating and compressing said first vapor stream to a first vapor stream pressure of from 40 bar to 120 bar to form a first constituent of said recycle gas;

(g) cooling a second part of said recycle gas to a temperature higher than an outlet temperature of said first gas expander;

(h) dividing the cooled second part of the recycle gas into first and second streams, cooling the first stream to form a methane-rich condensate and depressurizing said methane-rich condensate to form a liquid methane product, and passing the second stream to a second gas expander to form a second vapor stream; and, (i) reheating and compressing said second vapor stream to a pressure of from 40 bar to 120 bar to form a second constituent of said recycle gas.

8. The process according to claim 7, comprising cooling the mixture of feed gas and the first part of the recycle gas in a heat exchanger before passing the mixture to the first gas expander.

9. The process according to claim 7, comprising heating or cooling the first gas expander outlet stream in a heat exchanger prior to separation to modify the quantity of said higher hydrocarbons in the liquid.

10. The process according to claim 7, wherein the methane-rich feed gas pressure and the methane-rich recycle gas pressure are each from 50 bar to 100 bar and/or the first gas expander pressure is from 5 bar to 30 bar.

11. The process according to claim 7, comprising at least partially cooling the second part of the recycle gas by heat exchange with the second vapor stream prior to compressing said second vapor stream.

12. The process according to claim 7, wherein the methane-rich feed gas is natural gas.

* * * * *